US007773053B2

(12) United States Patent
Takayanagi et al.

(10) Patent No.: US 7,773,053 B2
(45) Date of Patent: Aug. 10, 2010

(54) SCANNING METHOD OF DISPLAY PANEL AND A DISPLAY UNIT

(75) Inventors: Haruyo Takayanagi, Tokyo (JP); Akira Kondo, Fukuoka (JP); Tetsuro Hara, Tokyo (JP); Naoya Kimura, Tokyo (JP); Takayuki Shimizu, Tokyo (JP); Shuji Furuichi, Tokyo (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 1200 days.

(21) Appl. No.: 11/193,352

(22) Filed: Aug. 1, 2005

(65) Prior Publication Data

US 2006/0022913 A1 Feb. 2, 2006

(30) Foreign Application Priority Data

Jul. 30, 2004 (JP) ..... 2004-223074

(51) Int. Cl.
*G09G 3/30* (2006.01)

(52) U.S. Cl. ..... 345/76; 345/89; 345/204; 345/690

(58) Field of Classification Search ..... 345/76, 345/89, 204, 690
See application file for complete search history.

(56) References Cited

U.S. PATENT DOCUMENTS 6,784,868 B2 * 8/2004 Murahashi et al. ..... 345/103

FOREIGN PATENT DOCUMENTS

EP 1353319 A 10/2003
JP 2003302937 A 10/2003

* cited by examiner

*Primary Examiner*—Richard Hjerpe
*Assistant Examiner*—Leonid Shapiro
(74) *Attorney, Agent, or Firm*—Rabin & Berdo, P.C.

(57) ABSTRACT

The object of the invention is elimination of an occurrence of instantaneous light in the center part of a display, a border between the upper half and the lower half of the display.

An scanning method of the display, dividing the display panel to a first filed and a second filed, starts a counter therein, synchronized with the timing of driving a first row electrode of the first filed thereof, and drives a first row electrode of the second filed thereof, every time the counter value changes.

3 Claims, 9 Drawing Sheets

SCANNING METHOD OF DISPLAY PANEL AND A DISPLAY UNIT

BACKGROUND OF THE INVENTION

Field of the Invention

The present invention relates to a scanning method of display panel and a display unit, especially a scanning method of display panel and a display unit for dividing a display panel to plurals of fields.

The document 1 discloses the conventional scanning method and the conventional display unit. According to the conventional technology of the document 1, the display panel having n (n: positive integer of multiples of two) of scanning lines is divided to the upper half having scanning lines from 1st to (n/2)th and the lower half from (n/2+1)th to (n)th. The disclosed method is that scanning of the upper half is done in the order of 1st, 2nd, - - - , (n/2)th line, scanning of the lower half is done in the order of (n/2+1)th, (n/2+2)th, - - - , (n)th.

The Document 1: Japanese Patent Application Laid-Open Number 2003-302937

However, according to the scanning method of the document 1, when there is some difference of scanning timing between the upper half and the lower half, the upper (n/2)th scanning line and the lower (n/2+1)th scanning line, respectively located next to each other, might be scanned at the same time.

Furthermore, the embodiments of the document 1 discloses the method that the scanning lines are divided to the upper half and the lower half, and the upper half line and the lower half line are scanned in the alternating order from every two lines equivalently located across the central axis of the panel. Although, in this case, the upper (n/2)th line and the lower (n/2+1)th line, located next to each other, must be scanned at the same time.

When the scanning lines next to each other are scanned at the same time, the scanning can be seen as if a only one line were scanned, and then there is a problem that a stronger light is observed than in other scanning lines.

Consequently, according to the conventional scanning method, there is a problem that every time one frame is displayed, the stronger light occurs in a moment at the center of the panel, the border between the upper half and the lower half.

SUMMARY OF THE INVENTION

According to a embodiment of the present invention, the scanning method of display panel is that the frame is displayed, dividing the display panel to the first field and the second field. A counter thereof is started, synchronized with the timing of driving the first row electrode of the first field thereof, and the first electrode of the second field is driven every time the counter value changes.

A display unit according to a embodiment of the present invention consists of a display panel, a first row driver, a column driver, a second row driver, a column driver, a first controller, and a second controller. The display panel is divided to the first and the second field. The first row driver drives the row electrode of the first field. The first column driver drives the column electrode of the first field. The second row driver drives the row electrode of the second field. The second column driver drives the column electrode of the abovementioned second field. The first controller controls the first row driver and the first column driver, and generates a sync signal, synchronized with driving one of the row electrodes of the first field. The second controller controls the second row driver and the second column driver, and starts driving the electrodes of the second field, synchronized with the sync signal thereof.

The scanning method of display panel and the display unit, according to the present invention, eliminates the instantaneous stronger lights at the center of the display panel.

DETAILED DESCRIPTION OF THE PREFERRED EMBODIMENTS

A dual scan driving, used in the scanning method of display panel according to the present invention, will be explained, referring to FIG. 1. The dual scan driving is that the row electrode is divided to two groups and each group is driven independently. By way of the explanation, the display panel in FIG. 1 is divided to two groups, however, it is obvious that dividing to three groups is applicable to the present invention.

Figure 1:
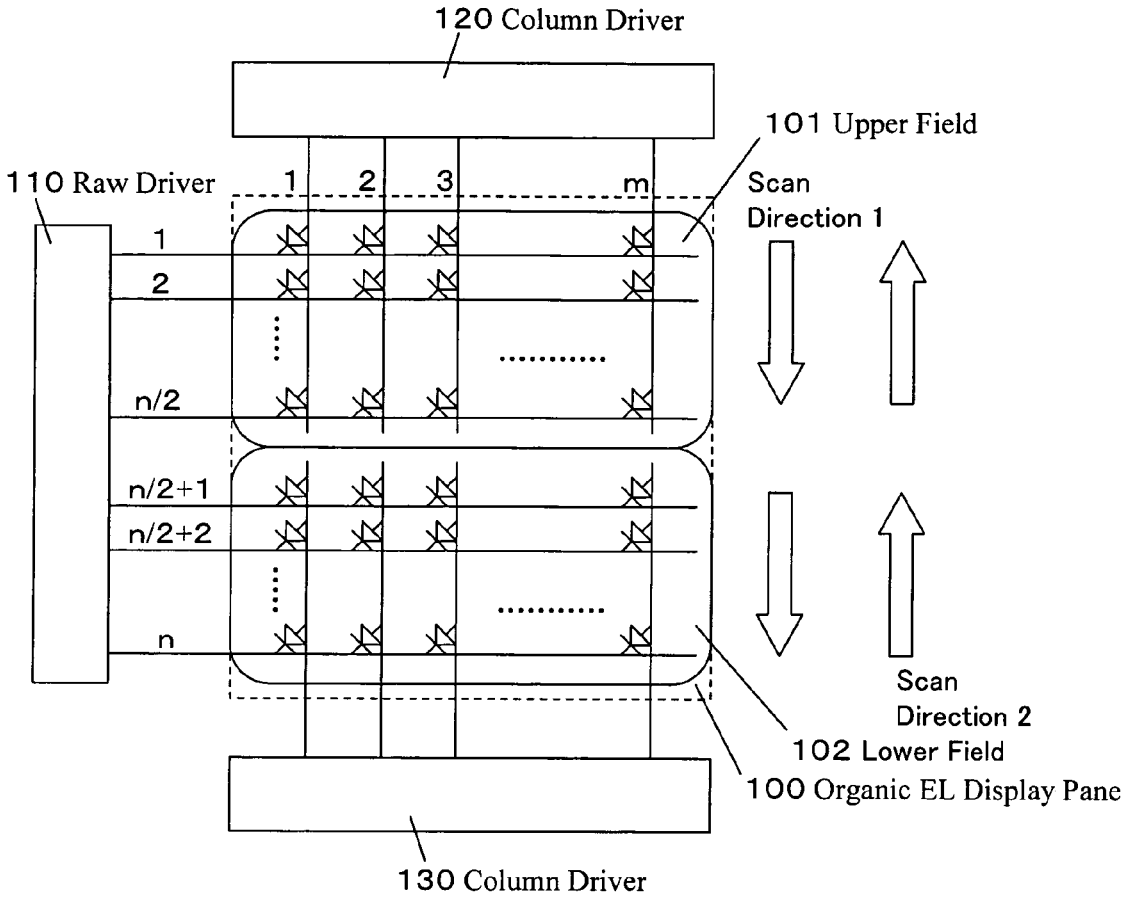
FIG. 1 is a block diagram of a part of the display unit of the present invention.

FIG. 1 is a view of a block diagram of a part of a display unit in accordance with the present invention. The display unit includes an organic EL display panel 100, a row driver 110, and a column driver 120,130. The row driver 110 has n (n: integers) of row electrodes. The column driver 120,130 drive m (m: integers) of column electrodes, respectively. The organic EL display panel 100 has a matrix structure of row electrodes and column electrodes and organic EL devices is formed at the cross points of the matrix.

In the dual scan driving, according to the present invention, the organic EL is divided to the upper field 101, consisting of from the 1st electrode to the (n/2)th electrode, and the lower field 102, consisting of from the (n/2+1)th electrode to the (n/2+2)th electrode. The abovementioned dual scan driving, according to the present invention, includes two scanning directions. The scanning direction 1 is that the row electrodes of the upper field 101 are scanned in the order from 1st, 2nd, - - - to (n/2)th and the row electrodes of the lower field 102 are scanned in the order of (n/2+1)th, (n/2+2)th, - - - , (n)th. In contrast, the scanning direction 2 is that the row electrodes of the upper field 101 are scanned in the order of (n/2)th, (n/2−1)th, - - - , 1st and the row electrodes of the lower field 102 are scanned in the order of (n)th (n−1)th, - - - , (n/2+1)th.

First Embodiment

Figure 2:
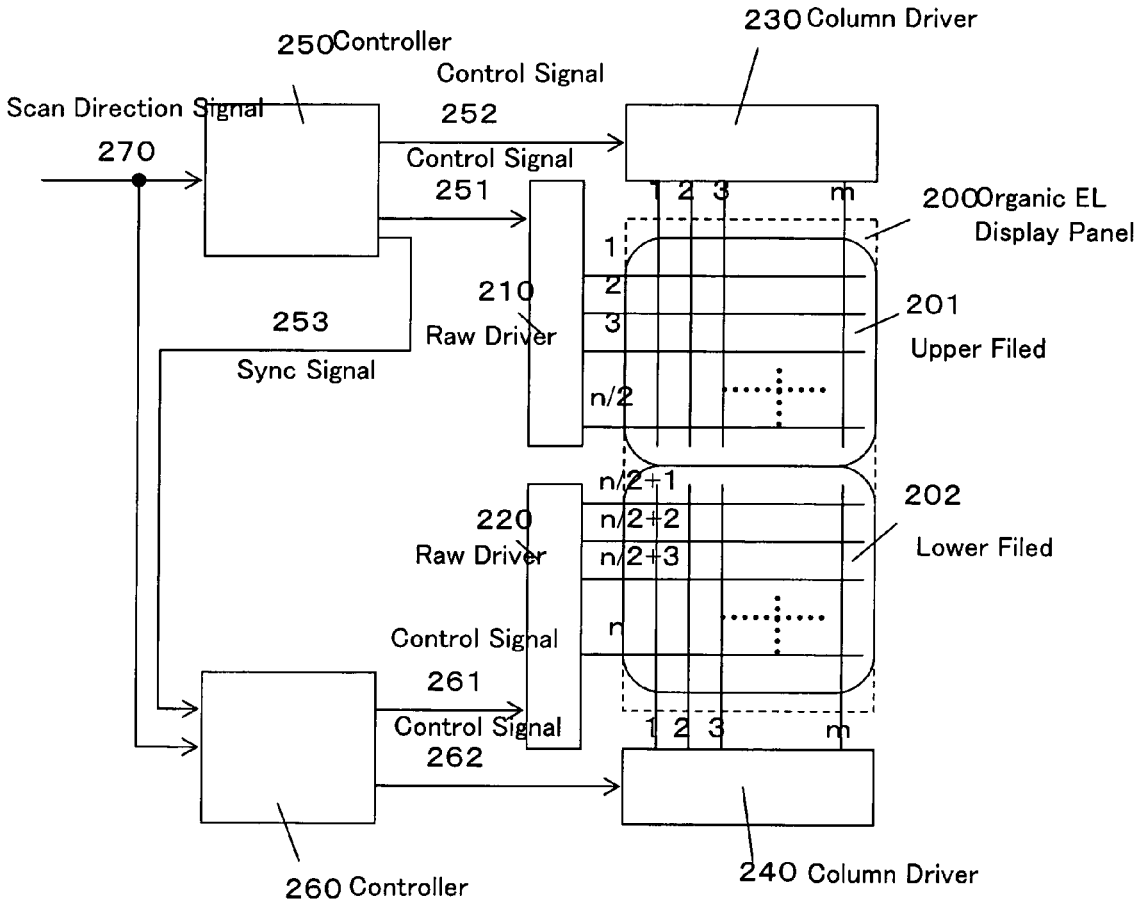
FIG. 2 is the view of a display unit according to a first embodiment of the present invention.

The first embodiment of the invention will be explained as below, referring to the drawing. FIG. 2 is a view of a display unit in accordance with a first embodiment of the present invention. The display unit includes an organic EL display panel 200, a first row driver 210, a second driver 220, a first column driver 230, a second column driver 240, a first controller 250, a second controller 260.

The organic EL display panel 200 is divided to the upper field 201 and the lower field 202. The first row driver 210 drives row electrodes of the upper field 201 of the organic EL display panel 200, and the second row driver 220 drives row electrodes of the lower field 202 of the organic EL display panel 200. The first column driver 230 derives column electrodes of the upper field 201 of the organic EL display panel 200, and the second column driver 240 derives column electrodes of the upper filed 202 of the organic EL display panel 200.

The first controller 250 connects the first row driver 210, the first column driver 230 and the second controller 260, together. The first controller 250 inputs a scan direction signal 270 and outputs a first control signal 251, a second control signal 252 and a sync signal 253. The first control signal 251 controls the first row driver 210. The second control signal 252 controls the first column driver 230. The sync signal 253 adjusts the synchronization of the second controller 260.

The second controller 260 connects the second row driver 220, the second column driver 240 and the first controller 250, together. The second controller 260 inputs a scan direction signal 270 and a sync signal 253, and outputs a third control signal 261 and a forth control signal 262. The third control signal 261 controls the second row driver 220. The forth control signal 262 controls the second column driver 240.

Figure 3:
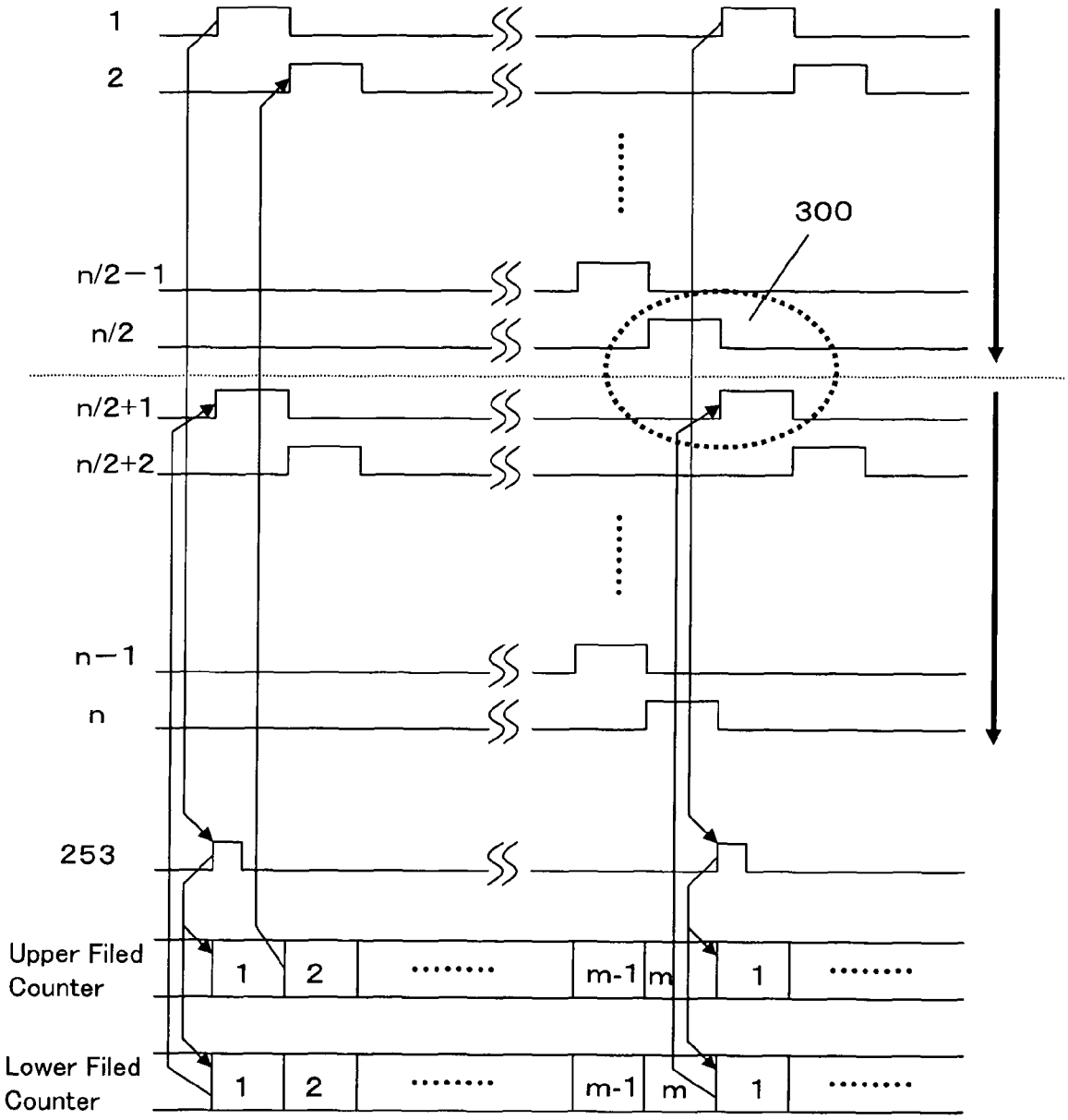
FIG. 3 is a timing chart of the scan direction 1.

A scanning method of display panel, according to the first embodiment of the present invention, will be explained as below, referring to the drawing. FIG. 3 is view of a timing chart of the scanning method of display panel in accordance with the first embodiment. The timing chart of FIG. 3 is based on the direction 1.

The first row driver drives electrodes in the order from 1st, 2nd, - - - , (n/2−1)th, (n/2)th. The driving method thereof will be explained specifically as below. Firstly, the first row driver 210 drives the first electrode and outputs the sync signal 253, as an one-shot pulse, at the same time. The first row driver 210 increments the counter value thereof one by one, detecting the rising edge of the sync signal 253. Where, the counter value thereof is incremented in the order of 1, 2, - - - , m−1, m. In addition, the counter value also can be decremented in the order of m, m−1, - - - , 2, 1. Secondly, the first row driver drives the second row electrode, detecting change of the counter value thereof from 1 to 2. Further, the first row driver 210 repeats the aforementioned driving sequence.

At the same time, the second row driver 220 drives the row electrodes in the order from (n/2+1)th, (n/2+2)th, - - - , (n−1) th, (n)th. The driving method thereof will be explained as below. The second row driver 220 increments the counter value thereof by one, detecting the rising edge of the sync signal 253 and outputs derives the (n/2+1)th electrode, at the same time. Where, the counter value thereof is incremented in the order of 1, 2, - - - , (m−1)th. In addition, the counter value can be decremented in the order of m, m−1, - - - , 2, 1. Secondly, the second driver 220 drives the (n/2+2)th electrode, detecting a change of the counter value from 1 to 2. Further, the second row driver 220 repeats the aforementioned driving sequence.

In the scanning method of display panel and the display unit, according to the first embodiment of the present invention, the changing timing of each electrode of the upper and lower field of the organic EL display matches each other. Then, the overlapping can be avoided between scan timing of the (n/2)th row electrode of the upper field and the (n/2+1)th row electrode of the lower field. (refer to the line of 300 in FIG. 3). Consequently, the scanning method of display panel and the display unit, according to the first embodiment of the present invention, can eliminates the instantaneous stronger lights at the center of organic EL display panels.

The direction 1 (from the top to the bottom) is explained as before, though, it is obvious that the fist embodiment of the present invention is applicable to the scanning direction 2 (from the bottom to the top).

Second Embodiment

Figure 4:
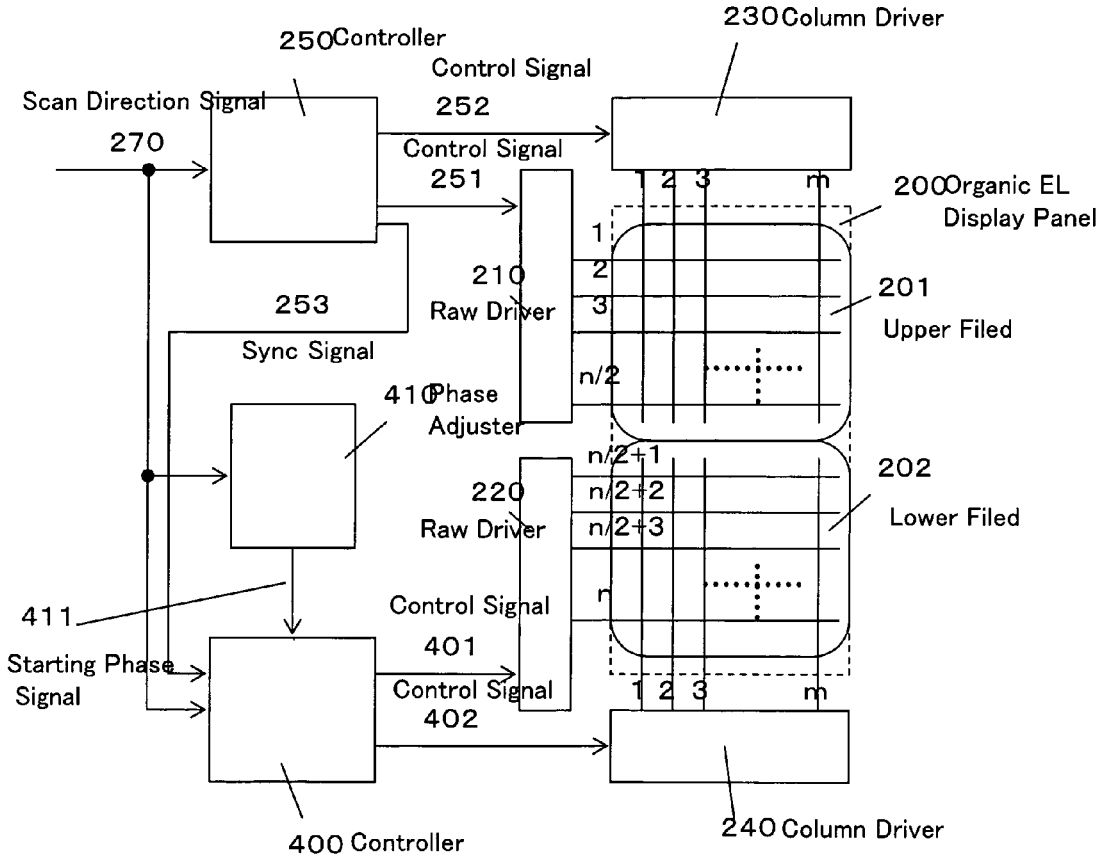
FIG. 4 is a block diagram of a display unit according to the second embodiment of the present invention.

A display unit, according to the second embodiment of the invention, will be explained as below, referring to the drawing. Where, the identical components to the components of the first embodiment are labeled with the same reference numbers, and the dual explanations are neglected. FIG. 4 is a display unit, according to the second embodiment of the invention. The display unit includes the organic EL display unit 200, the first row driver 210, the second row driver 220, the first column driver 230, the second column driver 240, the controller 250, a phase adjuster 410. A second controller 400 connects the second row driver 220, the column driver 240, the first controller 250, and the phase adjuster 410, together. The second controller 400 inputs the scan direction signal 270, the sync signal 253 and starting phase signal 411, and outputs the fifth control signal 401 and the sixth control signal 402.

The fifth control signal 401 controls the second row driver 220. The sixth control signal 402 controls the second column driver.

The phase adjuster 410 connects the second controller 400 and inputs the scan direction signal 270 and outputs the starting phase signal 411. The starting phase signal 411 adjusts the phase of the row electrodes of the lower field 202 of the organic EL display panel. The phase adjuster 410 judges the scanning direction thereof by the scanning direction signal 270. In the case of the scanning direction 1 (from the bottom to the top), the phase adjuster 410 outputs the one-clock-behind phase value to the second controller as the starting phase signal 411. Further, in the case of the scanning direction 2 (from the top to the bottom), the phase adjuster 410 outputs the one-clock-beyond phase value to the second controller as the starting phase signal 411.

At the same time, the second row driver 400 drives the row electrodes in the order of (n/2+1)th, (n/2+2)th, - - - , (n−1)th, (n)th. The driving method thereof will be explained as below. The second row driver 400 increments the counter value thereof by one, detecting the rising edge of the starting phase signal 411 and outputs derives the (n/2+1)th electrode, at the same time. Where, the counter value thereof is incremented in the order of 1, 2, - - - , (m−1)th. In addition, the counter value can be decremented in the order of m, m−1, - - - , 2, 1. Secondly, the second driver 400 drives the (n/2+2)th electrode, detecting a change of the counter value from 1 to 2. Further, the second row driver 400 repeats the aforementioned driving sequence.

Secondly, the scanning method of display panel of the scanning direction 2, according to the second embodiment of the present invention, will be explained, referring to FIG. 6. The first row driver 210 drives the row electrodes in the order of (n/2)th, (n/2−1)th, - - - , 2nd, 1st. The driving method will be explained specifically as below.

First, the first row driver 210 drives the (n/2)th row electrode, and outputs an one-shot pulse, as the sync signal 253, at the same time. The first row driver 210 increments the counter value thereof one by one, detecting the rising edge of the sync signal 253. Where, the counter value thereof is incremented in the order of 1, 2, - - - , m−1, m. In addition, the counter value also can be decremented in the order of m, m−1, - - - , 2, 1. Secondly, the first row driver 210 drives the (n/2−1)th row electrode, detecting a change of the counter value thereof from 1 to 2. Further, the first row driver 210 repeats the aforementioned driving sequence.

Where, the phase adjuster 410 outputs an one-shot pulse, as the starting phase signal 411.

At the same time, the second row driver 400 drives the row electrodes in the order of (n)th, (n−1)th, - - - , (n/2+2)th, (n/2+1)th. The driving method thereof will be explained specifically as below. The second row driver 400 increments the counter value thereof by one, detecting the rising edge of the starting phase signal 411 and outputs derives the (n)th electrode, at the same time. Where, the counter value thereof is incremented in the order of 1, 2, - - - , (m−1)th. In addition, the counter value also can be decremented in the order of m, m−1, - - - , 2, 1. Secondly, the second driver 400 drives the (n−1)th electrode, detecting a change of the counter value from 1 to 2. Further, the second row driver 400 repeats the aforementioned driving sequence.

As explained before, with the scanning method of display panel in accordance with the second embodiment of the invention, the phase value, one-clock-behind the phase of the first controller 250, is outputted to the second controller 400, as the starting phase signal 411, in the case of scanning direction 1 (from the top to the bottom). Then, in the case of the scan direction 1, the (n/2)th row electrode of the lower field is fired when the (n/2) the electrode of the upper field 201 is fired. Consequently, in the case of the scan direction 1, there is one-clock time-difference between the firings of the (n/2)th electrode of the upper field and the (n/2+1)th row electrode of the lower field, located at the center of the display panel.

In similarity, the phase value, one-clock-beyond the phase of the first controller 250, is outputted to the second controller 400, as the starting phase signal 411, in the case of scanning direction 2 (from the bottom to the top). Then, in the case of the scan direction 2, the 2nd row electrode of the lower field is fired when the (n/2+1)th electrode of the upper field 201 is fired. Consequently, in the case of the scan direction 2, there is one-clock time-difference between the firings of the (n/2)th electrode of the upper field and the (n/2+1)th row electrode of the lower field, located at the center of the display panel.

Figure 5:
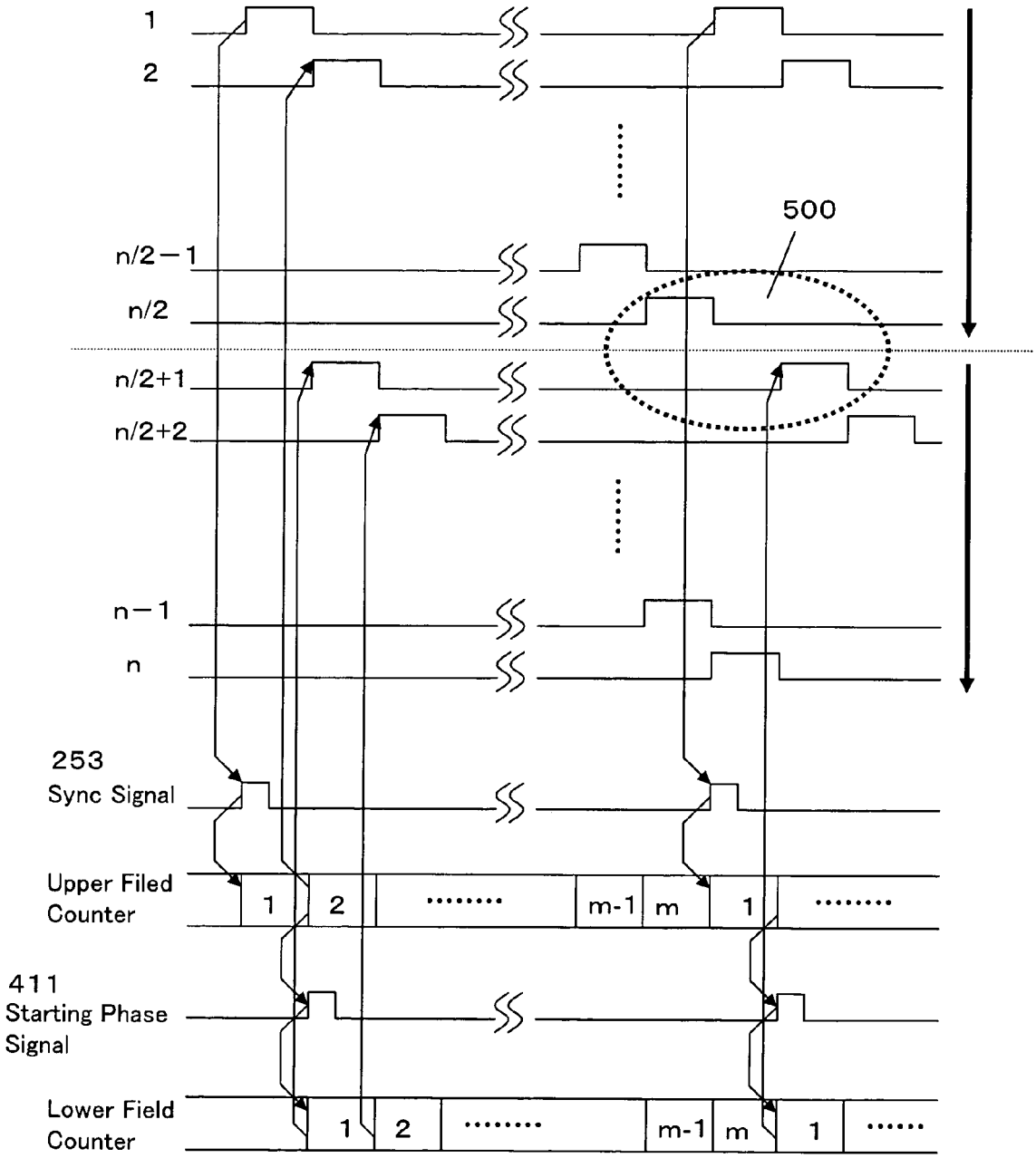
FIG. 5 is a timing chart of the scan direction 1.
Figure 6:
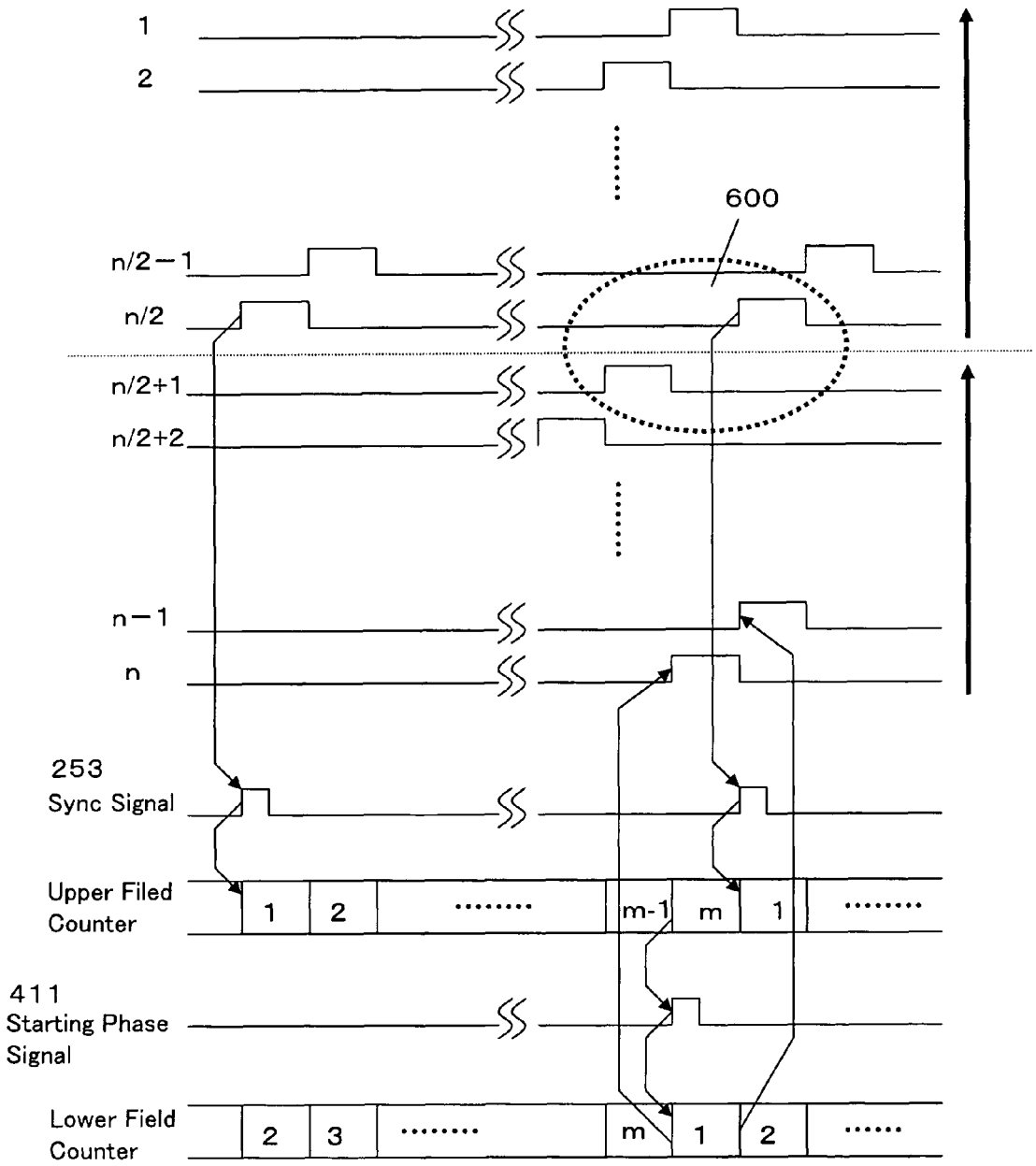
FIG. 6 is a timing chart of the scan direction 2.

The scanning method and the display unit, according to the second embodiment of the invention, can reduce the slight time difference between the firings of the (n/2)th row electrode of the upper field and the (n/2+1)th electrode of the lower field, caused by skews between the clocks of the first controller and the second controller and variations in the wiring delay time from each controller to each row driver (refer to the line of 500 of FIG. 5 and the line of 600 of FIG. 6).

In addition, the scanning method and the display unit, according to the second embodiment of the invention, delays the phase of the lower field by one clock in the case of direction 2, in advance. Subsequently the occurrence of instantaneous stronger lights can be decreased, even if the phase of the upper field is delayed by one clock. Further, in the case of the direction 2, the phase value of the lower field is proceeded by one clock, then the occurrence of instantaneous stronger lights can be decreased, even if the phase of the upper field is delayed by one clock.

The Third Embodiment

Figure 7:
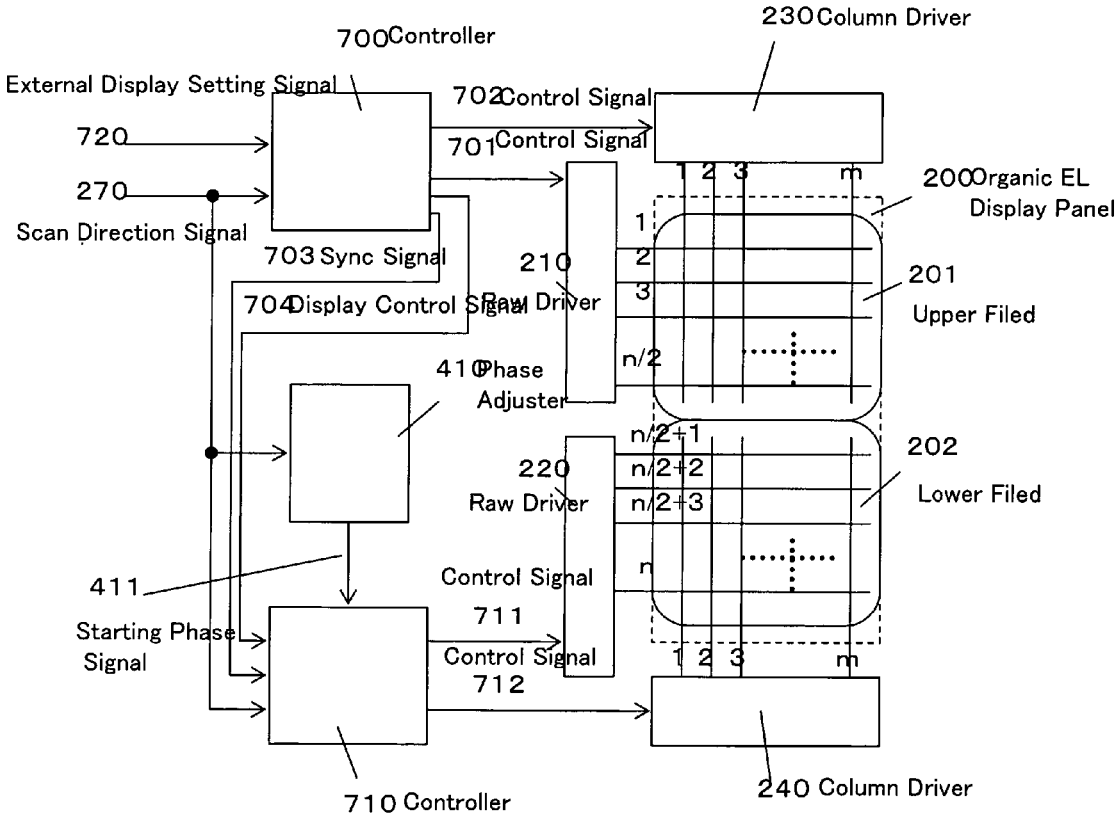
FIG. 7 is a block diagram of a display unit according to the third embodiment of the present invention.

The display unit, according to the third embodiment of the invention, will be explained, referring to the drawings. Where, the overlapped explanations are neglected, labeling the identical components to the components of the first embodiment or the second embodiment with the same reference numbers. FIG. 7 is a view of the display unit in accordance with the third embodiment of the invention. The display consists of the organic EL display panel 200, the first row driver 210, the second row driver 220, the first 220, the first column driver 230, the second column driver 240, the first controller 700, the second controller 710, and the phase adjuster 410.

The first controller 700 connects the first row driver, the column driver 230 and the second controller 710. The first controller 700 inputs the scan direction 270 and the external-display setting signal 720. Where, the external-display setting signal 720 includes the information of directions to change display mode, such as on-off directions to display images on the panel, directions to change the size of the display and directions to start or stop the screen saver. In addition, the first controller 700 outputs the seventh control signal 701, the eighth control signal 702, the sync signal 703 and the display control signal 704. The seventh control signal 701 controls the first row driver 210. The eighth control signal 702 controls the first column driver 230. The sync signal 703 adjusts the synchronization of the second controller 710. The display control signal 704 indicates the display mode information.

The second controller 710 connects the second row driver 220, the second column driver 240, the first controller 700 and the phase adjuster 410. The second controller 710 inputs the scan direction signal 270, the sync signal 703 and the display control signal 704, and outputs the ninth control signal 711 and the tenth control signal 712. The ninth control signal controls the second row driver 220. The tenth control signal 712 controls the second column driver 220.

The scanning method of display panel, according to the third embodiment of the invention, will be explained as below, referring to the drawings.

Figure 8:
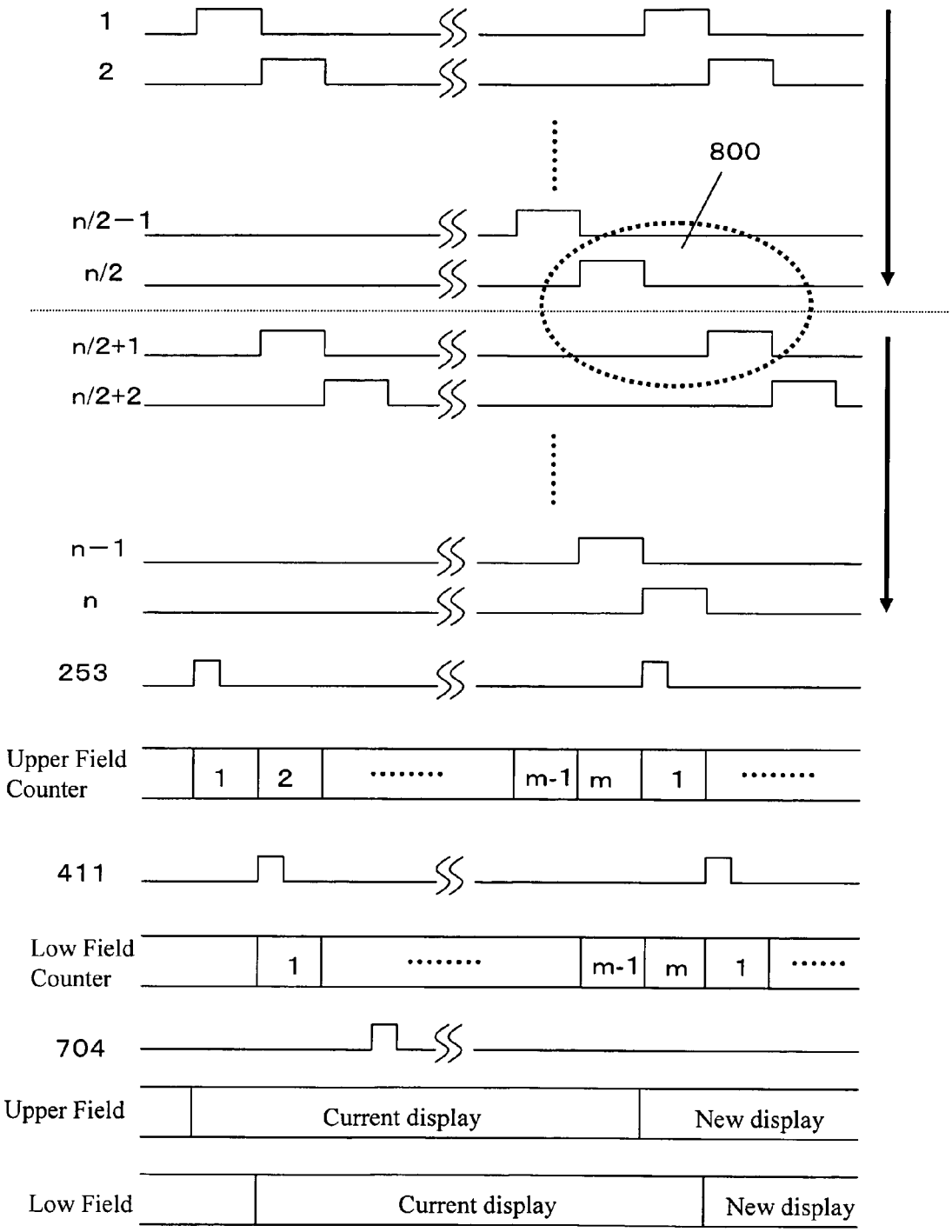
FIG. 8 is a timing chart showing the scan method of a display unit according to the third embodiment of the present invention.

FIG. 8 is a view of a timing chart of the scanning method of display panel in accordance with the third embodiment of the invention. Where, in the case of the scan direction 1, the period while all row electrodes is scanned in the order from 1st to (n/2)th is called a frame. When the display control signal 704 is inputted during the frame 1 thereof, the upper and the lower field of the display panel maintains the current information of display. Then the upper field updates the information of display to the new one, synchronized with the rising edge of the sync signal 703. Further, the lower field updates the information of display to the new one, detecting the rising edge of the starting phase signal 411 and synchronized with changing of the counter value from m to 1.

The scanning method and the display unit, according to the third embodiment of the invention, can reduce slight overlapping of firing time between (n/2)th electrode of the upper field and the (n/2+1)th electrode of the lower field, as the second embodiment (refer to the component 800 of FIG. 8). Subsequently, said scanning method and the display unit, according to the third embodiment of the invention, can reduce the occurrence of the stronger light caused by said slight overlapping of firing time.

Further, the scanning method of display panel and the scan unit, in according to the third embodiment of the invention, can get synchronization of every frame between the upper field and lower field, then the same operation over the whole display panel can be done even while the display mode is changed. In addition, the direction 1 (from the top to the bottom) is explained for the third embodiment of the invention. Although, it is obvious that the scan direction 2 is applicable to the third embodiment.

Figure 9:
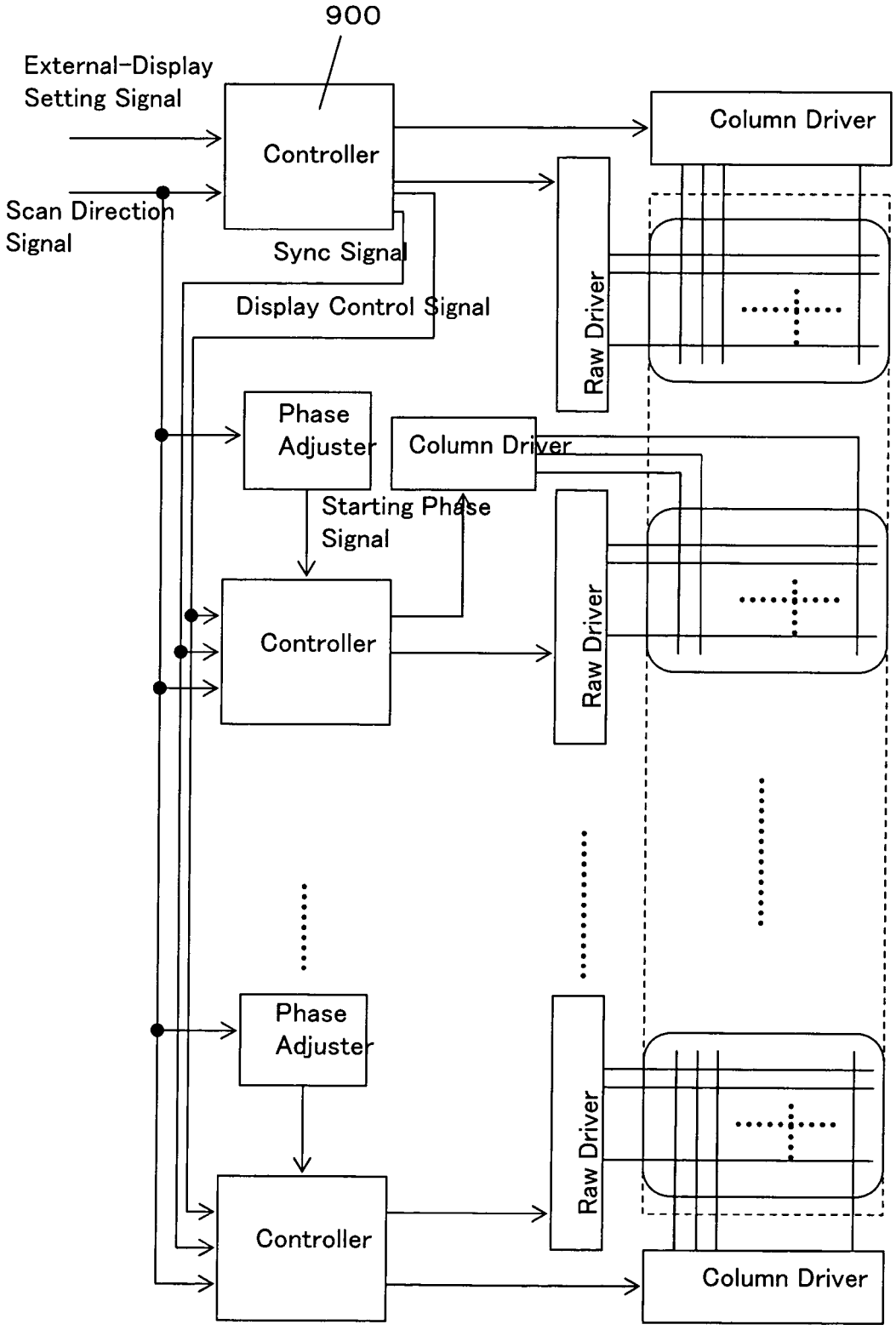
FIG. 9 is a block diagram of a display unit according to other embodiments of the present invention.

The dual scanning method dividing the display panel to two fields and the display unit using the above dual scanning method is explained, according to the first, the second and the third embodiment of the invention. However, the display in accordance with the embodiments of the invention is applicable to the case of dividing the panel to three fields, as showed in FIG. 9. In this case, the first controller 900 outputs the sync signal and other controllers are controlled by the sync signal thereof. In addition, according to the first, the second and the third embodiment of the invention, the display panel is described as the organic EL display panels. However, it is obvious that the thoughts of the scanning method and the display unit in accordance with the first, the second and the third embodiment of the invention can be applied to the liquid crystal display unit.

This is a counterpart of and claims priority to Japanese patent application Serial Number 223074/2004, filed on Jul. 30, 2004, the subject matter of which is incorporated herein by reference.

What is claimed is:

1. A scanning method of a display panel having a first field and a second field, the scanning method comprising:

driving an $n^{th}$ row line of the first field of the display panel, n being a positive integer;

driving a counter in synchronization with the driving of the $n^{th}$ row line of the first field; and driving an $n^{th}$ row line of the second field of the display panel at the same time with the driving of the $n^{th}$ row line of the first field in accordance with a change of a value of the counter, wherein a first row line of the second field is driven at a one-clock time-difference after a first row line of the first field is driven.

2. A scanning method of a display panel having a first field and a second field, the scanning method comprising:

driving an $n^{th}$ row line of the first field of the display panel, n being a positive integer;

driving a counter in synchronization with the driving of the $n^{th}$ row line of the first field;

driving an $n^{th}$ row line of the second field of the display panel at the same time with the driving of the $n^{th}$ row line of the first field in accordance with a change of a value of the counter;

changing a display mode of the first field in synchronization with the driving of the $n^{th}$ row line of the first field; and changing a display mode of the second field in accordance with the change of the value of the counter, wherein a first row line of the second field is driven at a one-clock time-difference after a first row line of the first field is driven.

3. A scanning method of a display panel having a first field and a second field, the scanning method comprising:

driving an $n^{th}$ row line of the second field of the display panel, n being a positive integer;

driving a counter in synchronization with the driving of the $n^{th}$ row line of the second field; and driving an nth row line of the first field of the display panel at the same time with the driving of the $n^{th}$ row line of the first field in accordance with a change of a value of the counter, wherein a last row line of the second field is driven at a one-clock time-difference before a last row line of the first field is driven.

* * * * *